US006196241B1

(12) United States Patent
Doolan

(10) Patent No.: US 6,196,241 B1
(45) Date of Patent: Mar. 6, 2001

(54) COLOR CHANGING UMBRELLA

(76) Inventor: Denise Doolan, 2801 Adams Mill Rd., NW., Apartment 407, Washington, DC (US) 20009

( * ) Notice: Subject to any disclaimer, the term of this patent is extended or adjusted under 35 U.S.C. 154(b) by 0 days.

(21) Appl. No.: 09/314,636

(22) Filed: May 19, 1999

(51) Int. Cl.[7] ..... A45B 3/00
(52) U.S. Cl. ..... 135/16
(58) Field of Search ..... 135/16, 33.2

(56) References Cited

U.S. PATENT DOCUMENTS

| | | | |
|---|---|---|---|
| D. 321,979 | | 12/1991 | DeSantis et al. . |
| 1,150,731 | | 8/1915 | Barcus . |
| 3,498,306 | | 3/1970 | Edelking . |
| 4,271,604 | | 6/1981 | Rowsey, Jr. . |
| 4,425,161 | | 1/1984 | Shibahashi et al. . |
| 4,872,468 | | 10/1989 | Cole . |
| 5,221,288 | | 6/1993 | Kamata et al. . |
| 5,294,375 | | 3/1994 | Kampe et al. . |
| 5,329,953 | * | 7/1994 | Becher ..... 135/31 |
| 5,389,093 | | 2/1995 | Howell . |
| 5,449,012 | * | 9/1995 | Friedman ..... 135/16 |

* cited by examiner

*Primary Examiner*—Beth A. Stephan
(74) *Attorney, Agent, or Firm*—Steptoe & Johnson LLP

(57) ABSTRACT

The present invention relates to an umbrella where the canopy is dyed with a color changing dye. The dye may be thermochromic, changing colors as the temperature changes. Photochromic dyes, which change color in sunlight, may also be used. The dye may be applied to the panels to form a variety of images.

21 Claims, 1 Drawing Sheet

COLOR CHANGING UMBRELLA

FIELD OF THE INVENTION

The present invention relates to umbrellas. More particularly, the present invention relates to umbrellas with canopies that change color.

BACKGROUND OF THE INVENTION

Umbrellas have been known and used for many years. Functionally, umbrellas most often are used to provide protection from precipitation, particularly rain. Umbrellas may also be used for protection from direct sunlight as in, for example, a parasol.

In addition to purely utilitarian functions, umbrellas have been designed for other uses. For example, U.S. Pat. Nos. 1,150,731 to Barcus and 4,271,604 to Rowsey describe umbrellas which may be used to locate and identify the various constellations.

Umbrellas may also contain other features that add further utility. For example, U.S. Pat. No. 4,872,468 to Cole describes a safety umbrella which contains a flashlight in the handle and a reflective strip on the canopy to increase visibility in the dark.

Umbrellas may additionally be used to express creativity. Creativity may be expressed in the various components of an umbrella. U.S. Pat. No. Des. 321,979 to DeSantis et al., for example, describes an umbrella wherein the elongated rod is illuminated. Creativity may also be expressed in the design present on the canopy, or by use of unique canopy materials. For example, U.S. Pat. No. 3,498,306 to Edelking describes an umbrella with a transparent canopy. Edelking also describes an umbrella having a transparent canopy with reflective dots. The use of unique materials in the design of umbrellas allows for novel means of expressing creativity.

SUMMARY OF THE INVENTION

The present invention relates to a novel means for expression. The unique means is achieved by building upon a standard construction for an umbrella consisting of an elongated rod with radial ribs attached at one end of the elongated rod and a canopy stretched over the radial ribs. In the present invention, the canopy contains several panels, one or more of which may be treated in whole or in part with dye capable of changing colors with a variation in ambient conditions.

In another aspect of the present invention, the color changing dye is thermochromic, changing colors as the temperature changes.

In another aspect of the present invention, the dye used is photochromic, changing colors under various light conditions.

In yet another aspect of the present invention, one panel contains a design applied with a color changing dye.

An additional aspect of the present invention, is to place a design or logo on a panel of the umbrella using a color change dye.

DETAILED DESCRIPTION OF THE PREFERRED EMBODIMENT

Figure 1:
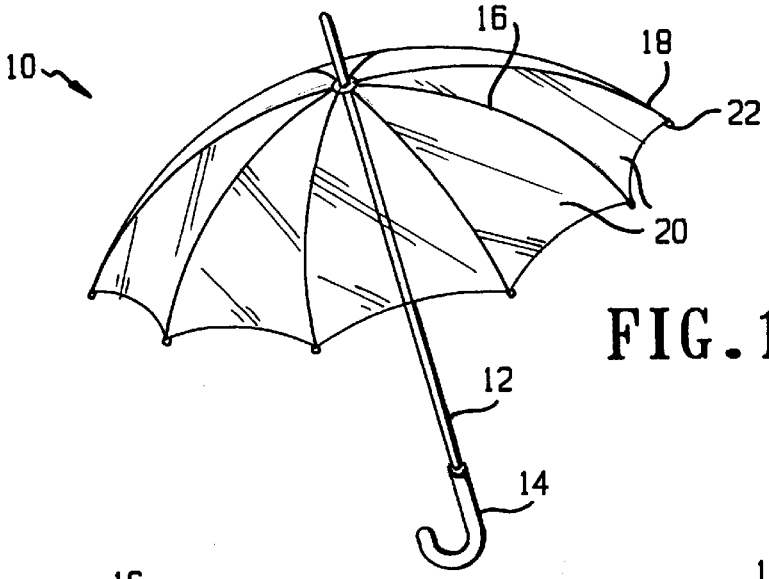
FIG. 1 is a perspective view of a prior art umbrella.

Referring now to the figures, wherein like reference numerals indicate like elements, in FIG. 1 there is shown the components of a typical umbrella which may be used for construction of the present invention. An elongated rod 12 provides support for a handle 14 for holding the umbrella, and further provides support for the radial ribs 16. The radial ribs 16 in turn support a canopy 18, which is composed of a series of panels 20, where each panel is situated between pairs of adjacent ribs. The panels extend from the tip of the elongated rod 12 to the tips of the radial ribs 22. The method for constructing such a typical umbrella is well known in the prior art.

In accordance with the present invention, one or more of the panels 20 are treated in various ways as described herein with one or more thermochromic dyes which change colors as the temperature changes. Alternatively, photochromic dyes which change color in the presence and absence of sunlight may be used. Thermochromic and photochromic dyes and methods for dyeing fabrics with these dyes are known in the prior art. For example, U.S. Pat. No. 5,221,288 to Kamada, the disclosure of which is incorporated herein by reference, discloses a method for applying a variety of dyes having different color-changing characteristics to yarns, composed of cellulose fiber or a variety of cellulose fiber blends, and fabrics and knits made from these materials. Further, U.S. Pat. No. 4,425,161 to Shibahoshi et al., the disclosure of which is incorporated herein by reference, teaches additional thermochromic dyes and inks and methods for using the same.

Figure 2:
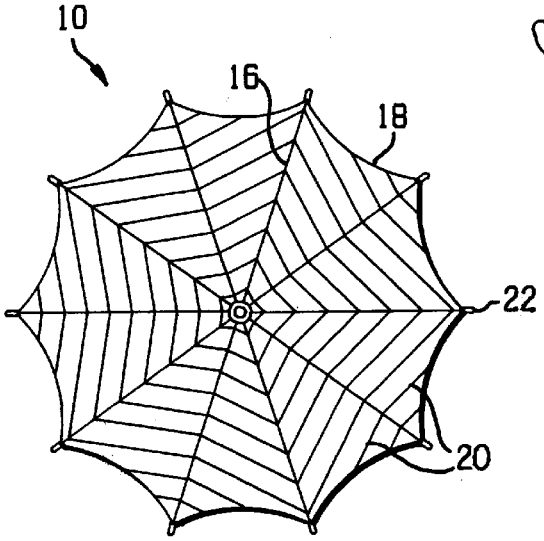
FIG. 2 is a top plan view of an umbrella in accordance with a first preferred embodiment of the invention.

FIG. 2 depicts a preferred embodiment of the present invention wherein all panels have been treated in their entirety with a color-changing dye. The thermochromic dyes should be chosen such that the cooling effect caused by precipitation causes the canopy to change color. Alternatively, as taught by Kamada, U.S. Pat. No. 5,221,288, more than one dye may be used so that the color of the canopy is dependent upon temperature.

As an alternative to the use of thermochromic dyes, the canopy material may be treated with photochromic dyes, as in Kamada, U.S. Pat. No. 5,221,288. An umbrella constructed in this manner would change color upon exposure to sunlight.

Figure 3:
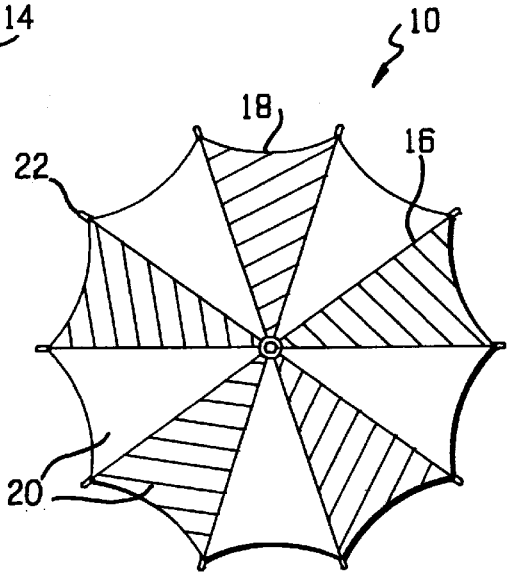
FIG. 3 is a top plan view of a second preferred embodiment of the invention.

FIG. 3 depicts a second preferred embodiment of the invention wherein the umbrella canopy is comprised of panels which alternate between panels treated with a color changing dye 20*a* and panels treated with dyes that retain the same color in all conditions 20*b*.

Other patterns of color changing and color fast panels can be selected. For example, the umbrella may be constructed such that only one panel has been treated with a color changing dye.

Figure 4A:
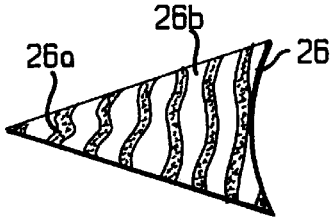
FIG. 4*a* is a top plan view of the umbrella of FIG. 1 having a first design in accordance with the present invention.

FIG. 4*a* shows an additional panel 26 which may be used to construct a color changing umbrella. In this panel 26 a random pattern of color changing dye has been applied to some regions 26*a* while other regions 26*b* are not treated with color changing dye. The dye may be applied by brush, screening, or any other suitable technique. For example, U.S. Pat. No. 5,389,093 to Howell, the disclosure of which is incorporated herein by reference, teaches the application of a thermochromic ink by conventional silk screening.

The panel 26 may be combined with other similarly treated panels to form a canopy wherein each panel exhibits a different pattern. Alternatively, the panels may be combined in such a way that a continuous pattern over the entire canopy is exhibited. Particular patterns may be achieved by, for example, matching corresponding regions of the pattern during assembly. The same result may also be obtained by constructing the canopy prior to application of the color changing dye and thus dyeing the entire canopy as a unit.

Figure 4B:
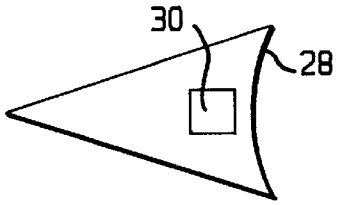
FIG. 4*b* is a top plan view of the umbrella of FIG. 1 having a second design in accordance with the present invention.

The panel 28 of FIG. 4*b* contains a region 30 in which the color changing dye creates a small design. One or more panels may contain such a design. The design may be, for example, a picture such as a tree, stars or other figures. Alternatively, the color changing dye may be applied to form a corporate logo or other trademark or trade designation such that the logo appears or disappears under certain conditions, e.g., temperature change or sunlight. A color changing umbrella containing one or more of these panels may be useful as, for example, promotional materials.

The above-description and drawings are only illustrative of preferred embodiments which achieve the features and advantages of the present invention, and it is not intended that the present invention be limited thereto. Any modification of the present invention which comes within the spirit and scope of the following claims is considered part of the present invention.

What is claimed is:

1. An umbrella comprising:

an elongated rod;

radial ribs supported at one end of said elongated rod; and a canopy composed of a plurality of fabric panels stretched over said radial ribs, wherein at least one of said panels has been treated with at least one color changing dye capable of changing color in response to external conditions.

2. The umbrella of claim 1, wherein said color changing dye used to treat the at least one of said panels is a thermochromic dye.

3. The umbrella of claim 1, wherein said color changing dye used to treat the at least one of said panels is a photochromic dye.

4. The umbrella of claim 1, wherein all of the material comprising said at least one of said panels has been treated with said color changing dye.

5. The umbrella of claim 1, wherein all of said panels comprising the canopy have been treated in their entirety with said color changing dye.

6. The umbrella of claim 1, wherein said color changing dye has been selectively applied to the at least one of said panels to create an image.

7. The umbrella of claim 6, wherein the at least one of said panels treated with said color changing dye are the same color as untreated panels when dry, and change color on exposure to rain or other precipitation such that said image appears only upon exposure to such rain or other precipitation.

8. The umbrella of claim 6, wherein said image comprises a random pattern on said one or more of said at least one of said panels.

9. The umbrella of claim 6, wherein said image is in the shape of stars distributed over all of said panels of said canopy.

10. The umbrella of claim 1, wherein the color changing dye is capable of changing color in response to exposure to precipitation.

11. An umbrella comprising:

canopy means for creating a cover of said umbrella;

a plurality of panel means for constructing said canopy means and wherein a color changing dye has been applied to at least one of said panel means, said dye being capable of changing color in response to external conditions;

a plurality of radial rod means for supporting said canopy means;

elongated rod means for supporting said radial rod means; and handle means at an end of the elongated rod means distal to said radial rod means for holding said umbrella.

12. The umbrella of claim 11, wherein the dye used to treat the at least one of said panel means is a thermochromic dye.

13. The umbrella of claim 11, wherein the dye used to treat the at least one of said panel means is a photochromic dye.

14. The umbrella of claim 11, wherein the color changing dye has been selectively applied to the at least one of said panel means to create an image.

15. The umbrella of claim 14, wherein said image is in the shape of stars distributed over all of said panel means of said canopy means.

16. A method for making a canopy for an umbrella, comprising:

treating a fabric with a color changing dye capable of changing color in response to external conditions; and forming said fabric into a canopy.

17. The method of claim 16, wherein said treating step further comprises the step of selectively applying said dye to said fabric to form an image.

18. The method of claim 17, wherein said color changing dye is a thermochromic dye.

19. The method of claim 17, wherein said color changing dye is a photochromic dye.

20. The method of claim 16, further comprising the step of joining said fabric treated with said color changing dye with material not treated with said color changing dye prior to forming said fabric into a canopy.

21. The method of claim 16, wherein the fabric is formed into said canopy before treatment with said dye.

* * * * *